US010279389B2

(12) United States Patent
Faoro

(10) Patent No.: US 10,279,389 B2
(45) Date of Patent: May 7, 2019

(54) MOLD FOR PRODUCING INGOTS AND BARS MADE OF PRECIOUS METAL

(71) Applicant: IKOI S.R.L., Cassola (IT)

(72) Inventor: Giovanni Faoro, Bassano del Grappa (IT)

(73) Assignee: IKOI S.P.A., Cassola (VI) (IT)

( * ) Notice: Subject to any disclaimer, the term of this patent is extended or adjusted under 35 U.S.C. 154(b) by 216 days.

(21) Appl. No.: 15/129,690

(22) PCT Filed: Mar. 30, 2015

(86) PCT No.: PCT/EP2015/000677

§ 371 (c)(1),
(2) Date: Sep. 27, 2016

(87) PCT Pub. No.: WO2015/149930

PCT Pub. Date: Oct. 8, 2015

(65) Prior Publication Data

US 2017/0144217 A1 May 25, 2017

(30) Foreign Application Priority Data

Mar. 31, 2014 (IT) ..... VI2014A0084

(51) Int. Cl.
*B22D 7/06* (2006.01)

(52) U.S. Cl.
CPC ..... *B22D 7/06* (2013.01)

(58) Field of Classification Search
CPC ..... B22D 7/06; B22C 9/00
See application file for complete search history.

(56) References Cited

U.S. PATENT DOCUMENTS 8,056,604 B2 * 11/2011 Duncan ..... B22D 46/00 164/150.1
2001/0050157 A1 12/2001 Drown
2007/0289715 A1 12/2007 Crafton et al.
2013/0319090 A1 12/2013 Prest et al.

FOREIGN PATENT DOCUMENTS

CN 101104198 A 1/2008
CN 103547393 A 1/2014
EP 1 162 290 A1 12/2001
WO WO 2012/130451 A1 10/2012

* cited by examiner

*Primary Examiner* — Kevin P Kerns
*Assistant Examiner* — Steven S Ha
(74) *Attorney, Agent, or Firm* — Finnegan, Henderson, Farabow, Garrett & Dunner LLP

(57) ABSTRACT

A mold for producing ingots and bars made of precious metal, comprising a body defining at least one cavity for forming an ingot, or a bar, closed in an upward region by at least one removable lid. The particularity of the mold according to the present invention resides in that it comprises at least one recess for forming a sample to be assayed, which is formed on the body, on the lid or on both.

19 Claims, 6 Drawing Sheets

MOLD FOR PRODUCING INGOTS AND BARS MADE OF PRECIOUS METAL

CROSS REFERENCE TO RELATED APPLICATIONS

This application is a national stage entry under 35 U.S.C. § 371 of International Application No, PCT/EP2015/000677 filed on Mar. 30, 2015, and claims priority to and the benefit of the filing date of Italian (IT) Patent Application No. VI2014A000084, filed on Mar. 31, 2014, the entire contents of which are incorporated by reference herein.

TECHNICAL FIELD

The present invention relates to an improved mold, particularly for producing ingots and bars made of precious metal.

BACKGROUND

As known, besides coining, there are essentially two production processes for making ingots, or bars, made of gold and other precious metals: a traditional method, which entails pouring the melt, i.e. molten metal, through a crucible into a mold of appropriate dimensions (the ingot mold), leaving then the melt to cool in air, making it solidify under the influence of flames generated by gas burners, or a more modern method, wherein granules, or other metal elements, are introduced in the mold and melted in a furnace, subsequently cooling the mold, and therefore also the molten metal contained therein, in a conveniently sized thermal container.

According to the more modern method, calibrated quantities of the material to be melted are initially introduced in molds with a shape that is substantially complementary to that of the ingots, or of the bars, to be provided.

The material to be melted can be constituted, for example, by grains, powder, crystals or swarf of various sizes.

The molds are thus inserted inside tunnel-type furnaces, preferably of the induction type, in which they are first heated up to the melting point of the metal and then cooled until the metal solidifies.

Recently, the more modern method has been recognized as compliant with the technical standards imposed by the London Bullion Market Association (LBMA), i.e. the trade association in the field of the professional market for ingots, for the production of so-called "good delivery" ingots.

It should be noted, however, that the LBMA also imposes that verifications of the purity level are to be performed on the produced ingots, regardless of which production process they originate from.

While there are instruments for purity verification that are well codified, and recognized also by the LBMA, for production systems that entail the use of crucibles, as regards the production of ingots melted directly in the molds, currently no instruments for purity verification are known.

SUMMARY

The aim of the present invention is to provide an improved mold, particularly for producing ingots and bars made of precious metal, that solves the problems of assessing the purity level of ingots or bars, melted directly in the mold with a continuous or static process.

Within the scope of this aim, a particular object of the invention is to provide an improved mold that generates a sample to be assayed and which has the same physical-chemical characteristics as the ingot or bar.

Another object of the present invention is to provide an improved mold which, because of its particular constructive characteristics, can be technically validated by the LBMA.

Another object of the present invention is to provide an improved mold which, by virtue of its particular constructive characteristics, is capable of giving the greatest assurances of reliability and safety in use.

This aim and these and other objects that will become better apparent hereinafter are achieved by an improved mold for producing ingots and bars made of precious metal, comprising a body forming at least one cavity for forming an ingot or a bar, said cavity being closed in an upper region by at least one removable lid; said mold being characterized in that at least one of either said body or said lid comprises at least one recess for forming a sample to be assayed.

BRIEF DESCRIPTION OF THE DRAWINGS

Further characteristics and advantages will become better apparent from the description of preferred but not exclusive embodiments of an improved mold according to the invention, illustrated by way of non-limiting example in the accompanying drawings, wherein.

DETAILED DESCRIPTION

Figure 1:
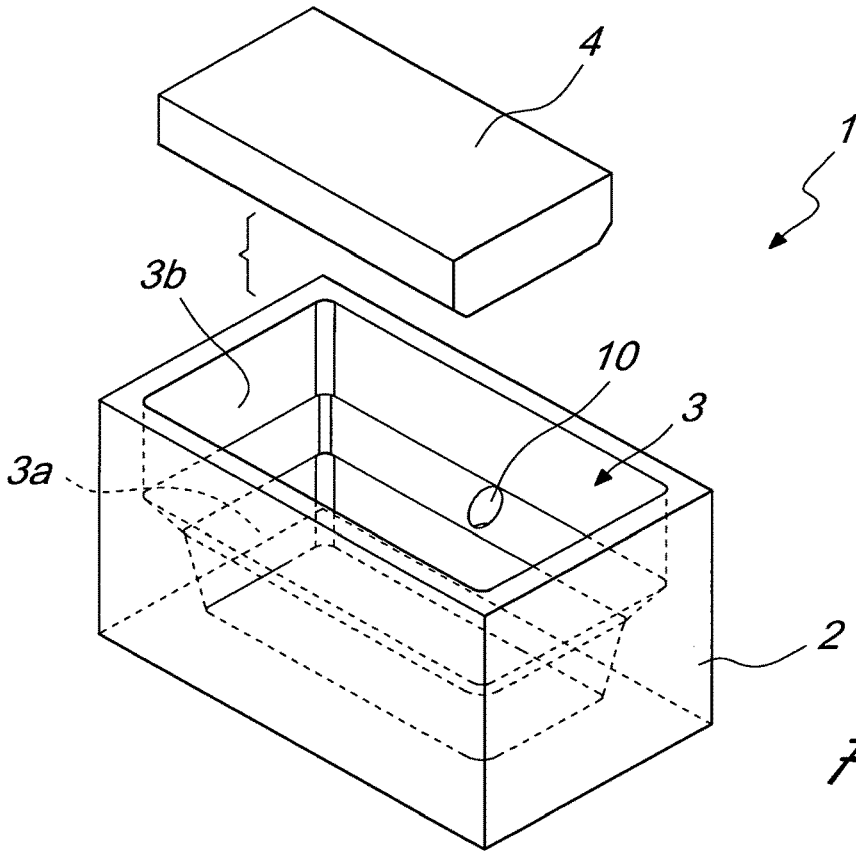
FIG. 1 is a perspective view of an improved mold according to the invention.
Figure 2:
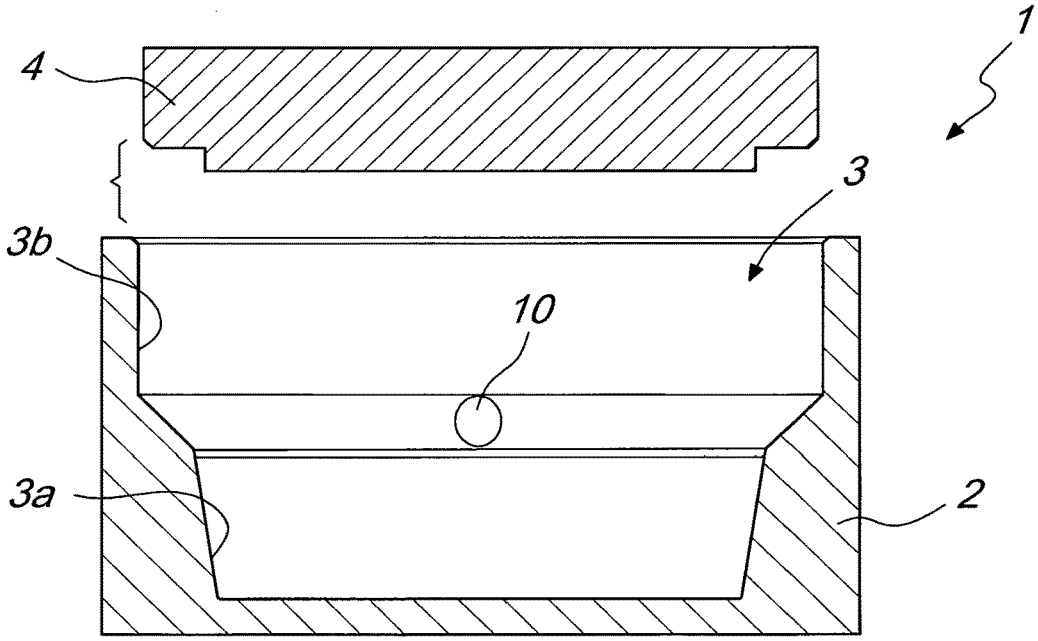
FIG. 2 is a longitudinal sectional view of the mold of FIG. 1.
Figure 3:
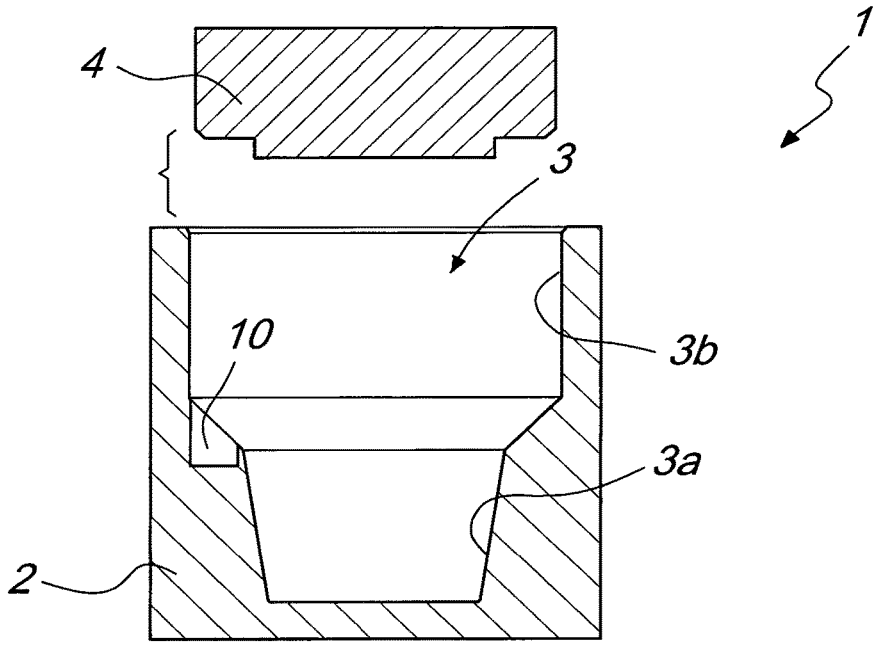
FIG. 3 is a transverse sectional view of the mold of FIG. 1.
Figure 4:
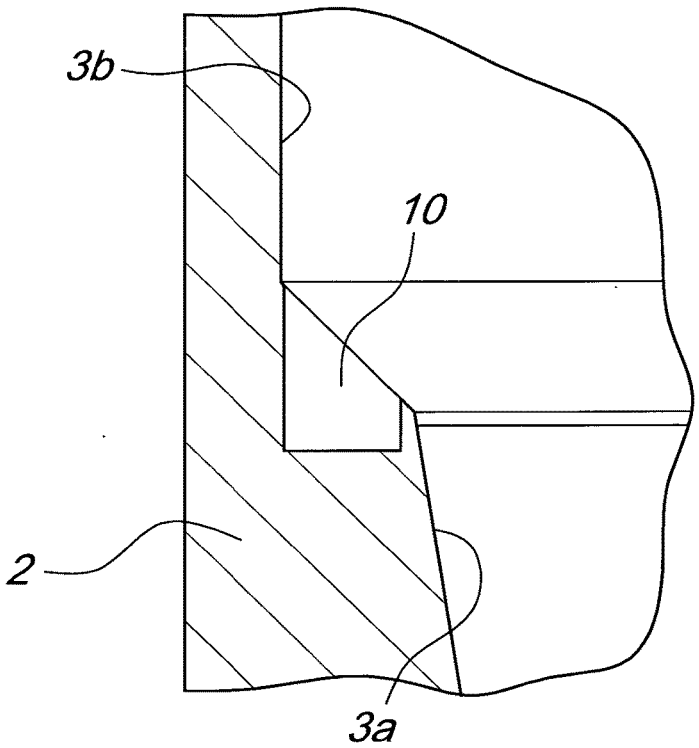
FIG. 4 is a sectional view of a detail of the mold of FIG. 1.

With reference to FIGS. 1 to 4, the improved mold, particularly for producing ingots and bars made of precious metal, and generally designated by the reference numeral 1, comprises a body 2 forming at least one cavity 3 for molding an ingot or a bar.

The cavity 3 is peripherally delimited by side walls, which are closed in a lower region by a bottom wall and in an upper region by at least one removable lid 4.

The cavity 3 has a lower portion 3*a* with a shape that is substantially complementary to the shape of the ingot or bar, and an upper portion 3*b* with a shape adapted to facilitate the introduction of material to be cast, constituted, for example, by grains, powder, crystals or swarf, of various size.

In the illustrated example, the upper portion 3*b* has lateral surfaces that are at least partially inclined and converge toward the bottom of the cavity 3.

However, the mold may also have an upper portion 3*b* with lateral surfaces that are substantially perpendicular to the bottom of the cavity 3.

Advantageously, the lid 4 is conceived so that it can pass from a first position, in which it rests on the material to be melted without resting on the body 2, to a second position, in which it rests on the body 2, closing the cavity 3 in an almost complete manner.

In the second position, the lid 4 can make contact with different parts of the body 2, depending on how the mold 1 is built.

If the lid 4 is without portions that protrude laterally, as shown in the figures, in the second position the lid may for example rest its sides, or a shank, on the internal walls of the cavity 3 or on an abutment formed inside it.

As an alternative, if the lid 4 is for example provided with a peripheral edge, in the second position this edge may rest on the upper end of the body 2.

The translation from the first position to the second position occurs during casting, i.e., when the volume occupied by the mass of the material to be cast reduces gradually.

Conveniently, the body 2 and the lid 4 may be constituted by one or more components made for example of graphite, graphite mixes, silicon carbide or of any other material that is compatible with the metal being cast and withstands high temperatures.

According to the present invention, the mold 1 comprises at least one recess 10 that generates a sample to be assayed.

Advantageously, said sample is produced simultaneously with the ingot or bar, and has its same physical-chemical characteristics.

Merely for the sake of simplicity in description, the presence of a single recess 10 is assumed.

The recess 10 may be constituted by a variously shaped hollow provided with an access opening that connects it to the cavity 3.

According to a first embodiment, the access opening is formed at a level, with respect to the bottom of the cavity 3, that is higher than the level reached by the material that is present in said cavity 3 at the end of the casting process.

In practice, this embodiment allows to obtain a sample to be assayed that is separate from the ingot or bar, formed in the main cavity 3.

With particular reference to the embodiment shown in FIGS. 1 to 4, the recess 10 is for example formed at one of the walls laterally delimiting the cavity 3.

The position of the recess, according to the invention, may vary depending on specific requirements.

Figure 5:
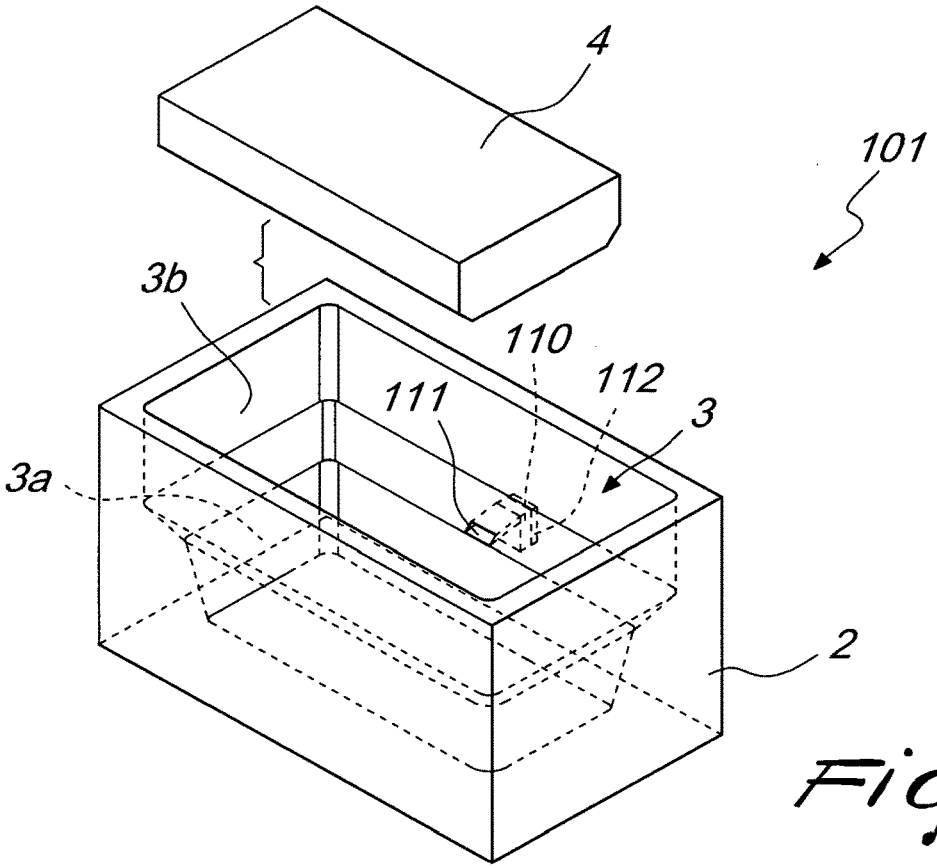
FIG. 5 is a perspective view of a further embodiment of an improved mold according to the invention.
Figure 6:
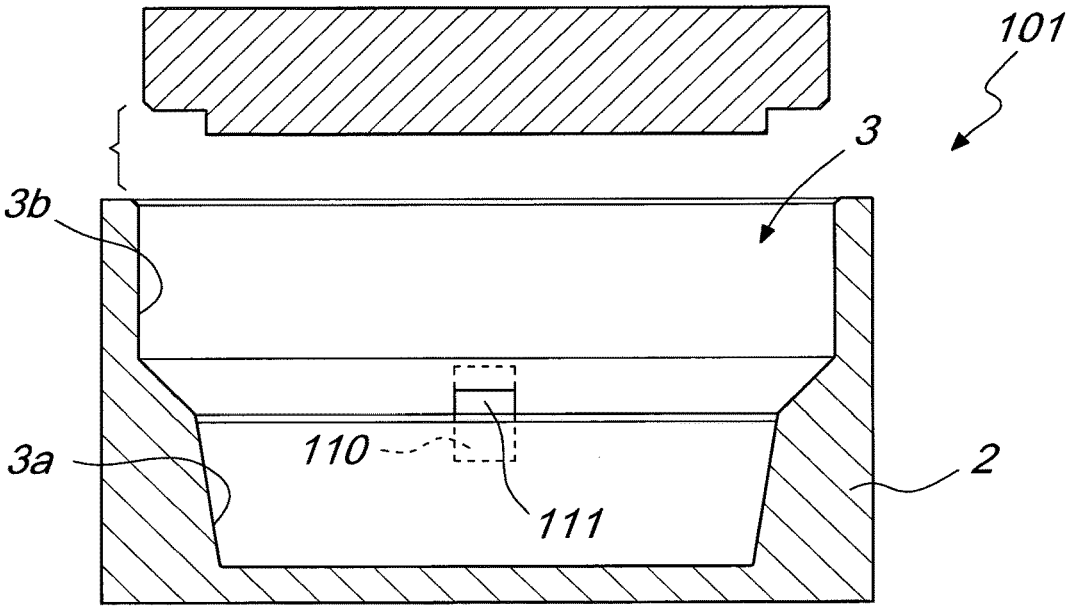
FIG. 6 is a longitudinal sectional view of the mold of the FIG. 5.
Figure 7:
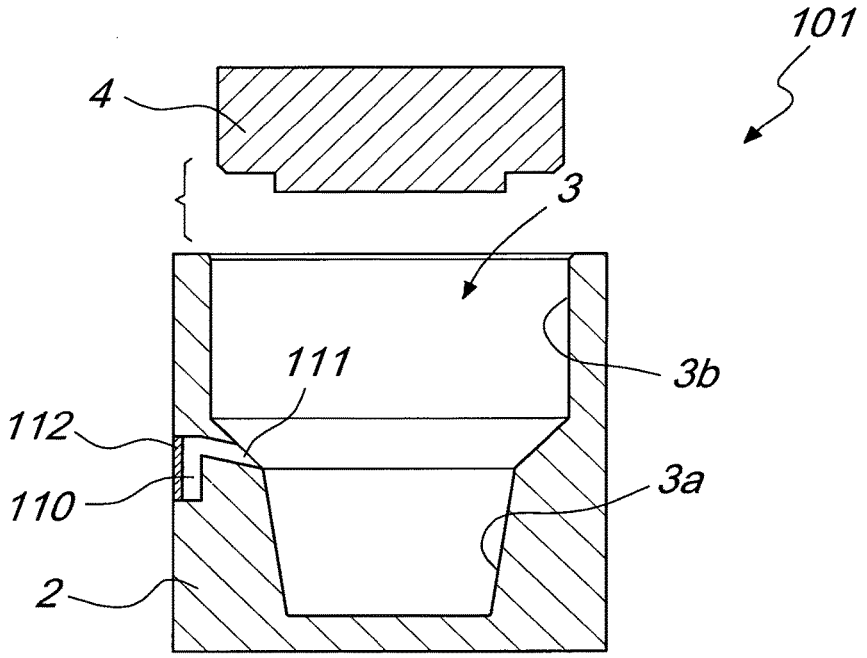
FIG. 7 is a transverse sectional view of the mold of FIG. 5.

For example, in the embodiment shown in FIGS. 5 to 7, wherein the improved mold according to the invention is designated by the reference numeral 101, the recess 110 is constituted by a hollow formed at one of the side walls of the cavity 3 and connected to it by means of a duct 111, conveniently directed toward the bottom of said cavity 3.

The inclination of the duct 111 prevents the material that fills the cavity 3 from reaching the recess 110, unless done intentionally.

Advantageously, the recess 110 is laterally delimited by a wall 112 detachably associated with the body 2 and constituted, for example, by a stopper or a plug of suitable shape.

Figure 8:
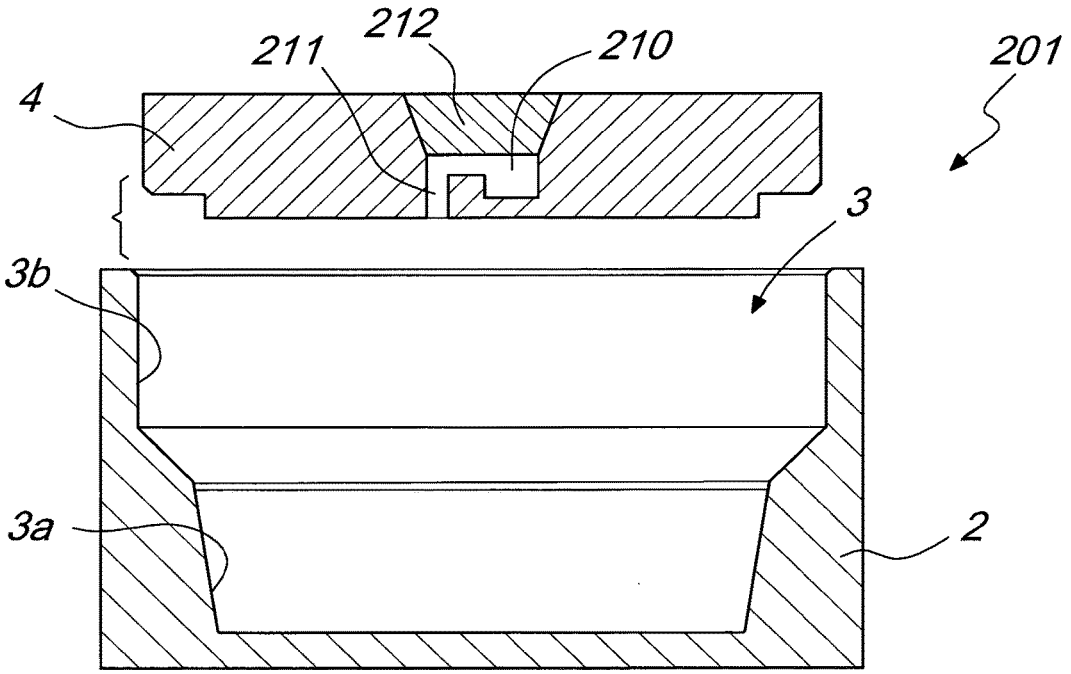
FIG. 8 is a longitudinal sectional view of a further embodiment of an improved mold according to the invention.

In a further embodiment, illustrated in FIG. 8, wherein the improved mold according to the invention is designated by the reference numeral 201, the recess 210 is formed in the lid 4 and is connected to the cavity 3 by means of a duct 211 that is conveniently shaped and directed toward the bottom of said cavity 3.

Conveniently, in this case, the recess 210 may be delimited in an upper region, or laterally, by a wall 212 that is detachably associated with the lid 4 and is constituted by a stopper or a plug.

According to a further embodiment of the invention, the access opening of the recess is formed at a level, with respect to the bottom of the main cavity 3, that is lower than the level reached by the material present in the same cavity 3 at the end of the casting process.

In this case, the sample to be assayed will be monolithic with the ingot or bar formed in the cavity 3.

Figure 9:
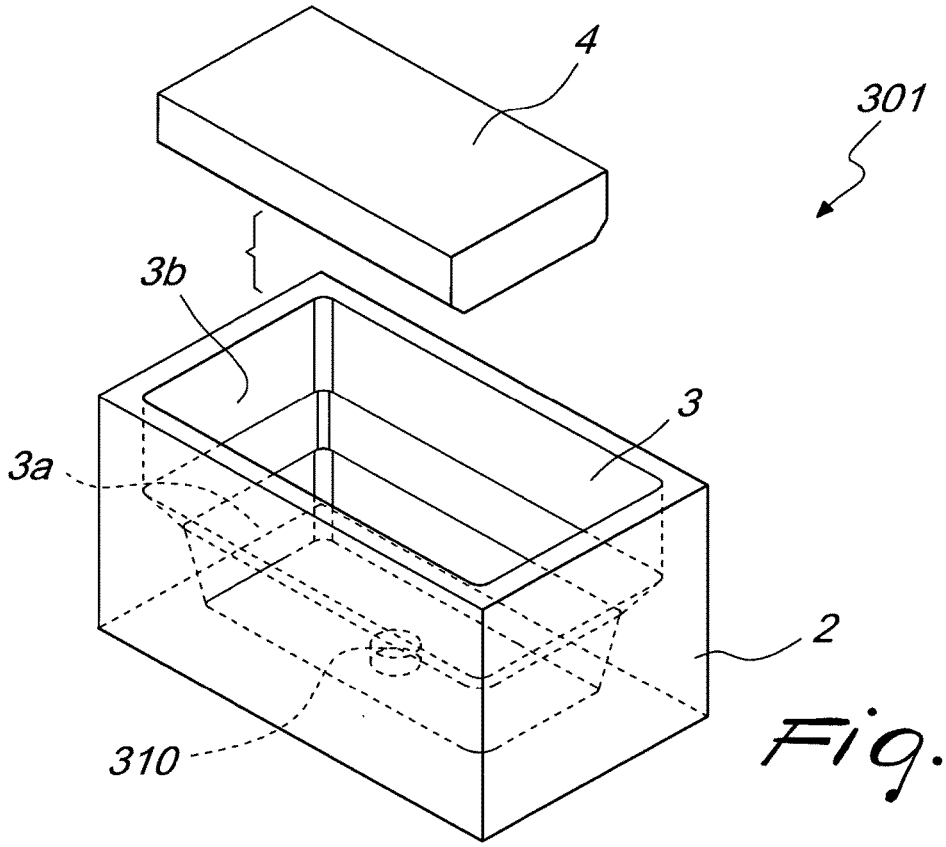
FIG. 9 is a perspective view of still a further embodiment of an improved mold according to the invention.
Figure 10:
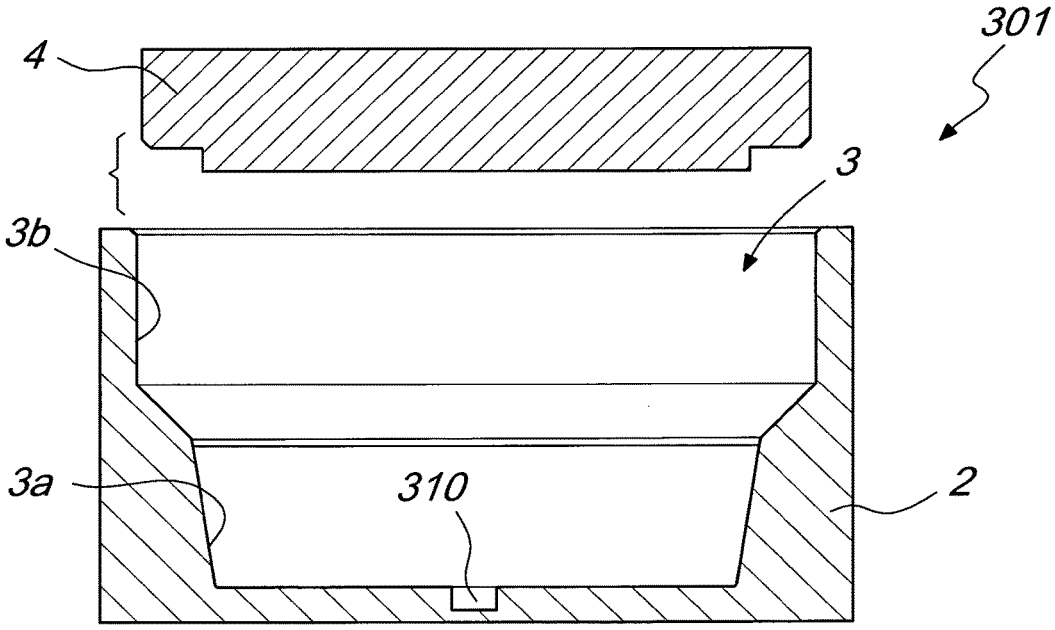
FIG. 10 is a longitudinal sectional view of the mold of the FIG. 9.
Figure 11:
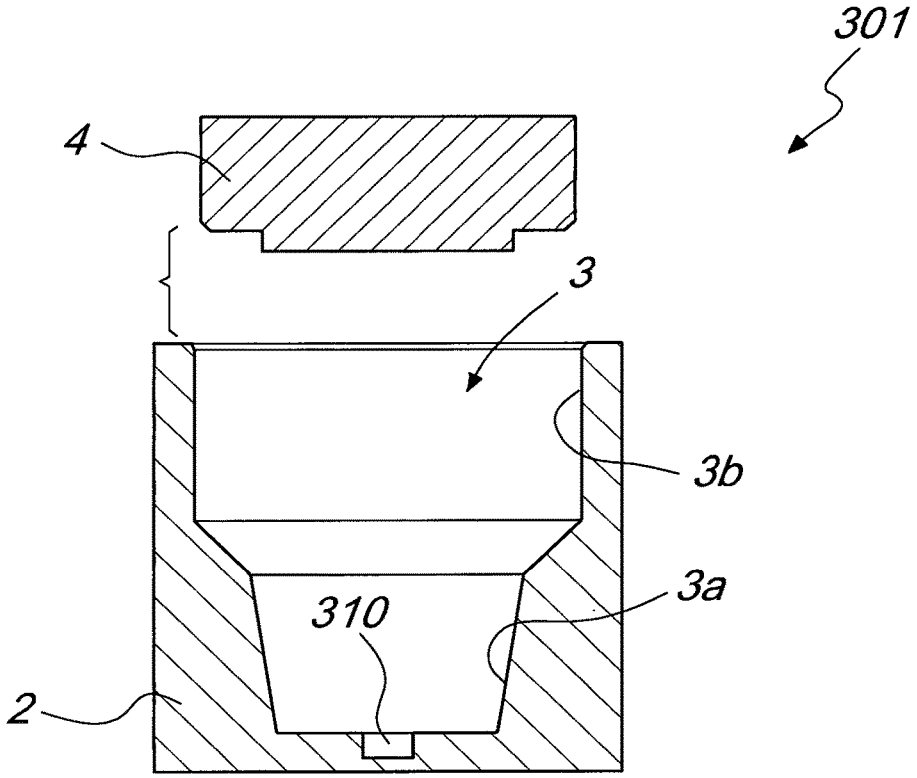
FIG. 11 is a transverse sectional view of the mold of FIG. 8.

As shown in FIGS. 9 to 11, the improved mold, designated by the reference numeral 301, has a recess 310 formed on the bottom of the cavity 3.

In a further embodiment, not shown in the figures, the recess according to the invention is formed on the walls that laterally delimit the cavity 3.

In the embodiments shown in FIGS. 5 to 11, the elements that correspond to the elements described with reference to the embodiment shown in FIGS. 1 to 4 have been designated by the same reference numerals.

The use of the improved mold for producing ingots and bars made of metal according to the invention, is as follows.

A precise quantity of material to be cast, constituted, for example, by grains, powder, crystals or swarf of various sizes, is introduced in the cavity 3 to form an ingot or a bar.

In performing this operation, in the case of the first described embodiment, part of the material introduced also fills the recess 10.

The cavity 3 is then closed by means of the lid 4, which rests on the material to be cast, so as to compress it, without however abutting.

At this point, the material contained in the cavity 3 begins to melt and to gradually reduce its volume, consequently the lid 4 lowers and substantially completely closes the main cavity 3.

Simultaneously with the shrinkage of the material being melted, there is also a lowering of its level, which drops below the level of the access inlet of the recess 10.

In this manner, while the ingot or bar is formed in the lower portion 3*a* of the cavity 3, a sample is generated in the recess 10 and can be easily assayed.

In the case of the second described embodiment, the melted material flows into the recess 110 through the duct 111.

It is therefore possible, for example, to tilt the body 2 until part of the molten material flows through the duct 111, so as to fill the recess 110 and generate the sample to be assayed.

This sample can be easily extracted by temporarily removing the wall 112.

As an alternative, a temporary rise of the level of the molten material may be obtained, for example with an appropriate pressure on the lid 4 when is not yet totally rested, so as to transfer part of the molten material into the recess 110 through the duct 111.

The temporary tilting of the body 2 or the pressure on the lid 4 may be effective also in the case of the recess 210 formed in said lid 4.

In this case, the sample to be assayed can be easily extracted by temporarily removing the wall 212.

In the case of the recess 310, the sample to be assayed is constituted by a protrusion joined monolithically to the ingot or bar, from which it must be mechanically separated.

In practice it has been found that the invention achieves the intended aim and objects, providing an improved mold, particularly for producing ingots and bars made of precious metal, that solves the problem of determining the purity level of ingots, or bars, cast directly in the mold with a continuous process.

In fact, in the improved mold according to the invention, a sample to be assayed is generated simultaneously with the ingot or bar, and since it has the same physical-chemical characteristics as the finished product, the sample can be used to determine the purity level thereof.

The invention claimed is:

1. A mold for producing an ingot or a bar made of precious metal, comprising:

a body forming a cavity configured to form the ingot or the bar, the cavity being closed in an upper region by a removable lid, wherein:

at least one of the body or the removable lid comprises a recess configured to form a sample to be assayed, wherein the recess is coupled to the cavity by an access opening.

2. The mold according to claim 1, wherein:

the mold is used in a casting process;

at a bottom of the cavity, the access opening is formed at a level that is higher than a level reached, at an end of the casting process, by material to be cast that is introduced in the cavity; and the sample to be assayed is separate from the ingot or from the bar.

3. The mold according to claim 2, wherein:

the removable lid is movable between a first position and a second position with a gradual reduction of the volume of material to be cast during the casting process;

wherein:

in the first position the lid rests on the material to be cast without resting on the body; and in the second position the lid rests on the body such that the lid closes the cavity.

4. The mold according to claim 1, wherein the recess is formed in a side wall of the cavity.

5. The mold according to claim 1, wherein the recess is coupled to the access opening by a duct that is directed toward a bottom of the cavity.

6. The mold according to claim 1, wherein the recess is formed in the removable lid.

7. The mold according to claim 1, wherein:

the mold is used in a casting process;

at a bottom of the cavity, the access opening is formed at a level that is lower than a level reached, at an end of the casting process, by material to be cast that is introduced into the cavity; and the sample to be assayed is connected to the ingot or the bar.

8. The mold according to claim 1, wherein the recess is formed in a bottom wall of the cavity.

9. The mold according to claim 1, wherein the cavity includes:

a lower portion having a shape that is substantially complementary to a shape of the ingot or the bar, and an upper portion having a shape configured to accept material to be cast.

10. A mold for producing an ingot or a bar made of precious metal, comprising:

a body forming a cavity configured to form the ingot or the bar, the cavity being closed in an upper region by a removable lid, wherein:

at least one of the body or the removable lid comprises a recess configured to form a sample to be assayed; and wherein the recess is laterally delimited by a wall that is detachably coupled to the body.

11. . The mold according to claim 10, wherein the recess is coupled to the cavity by an access opening.

12. The mold according to claim 11, wherein:

the mold is used in a casting process;

at a bottom of the cavity, the access opening is formed at a level that is higher than a level reached, at an end of the casting process, by material to be cast that is introduced in the cavity; and the sample to be assayed is separate from the ingot or from the bar.

13. The mold according to claim 11, wherein the recess is coupled to the access opening by a duct that is directed toward a bottom of the cavity.

14. The mold according to claim 11, wherein:

the mold is used in a casting process;

at a bottom of the cavity, the access opening is formed at a level that is lower than a level reached, at an end of the casting process, by material to be cast that is introduced into the cavity; and the sample to be assayed is connected to the ingot or the bar.

15. The mold according to claim 10, wherein the cavity includes:

a lower portion having a shape that is substantially complementary to a shape of the ingot or the bar, and an upper portion having a shape configured to accept material to be cast.

16. A mold for producing an ingot or a bar made of precious metal, comprising:

a body forming a cavity configured to form the ingot or the bar, the cavity being closed in an upper region by a removable lid, wherein:

at least one of the body or the removable lid comprises a recess configured to form a sample to be assayed, wherein the recess is delimited by a wall that is detachably coupled to the removable lid.

17. The mold according to claim 16, wherein the recess is coupled to the cavity by an access opening.

18. The mold according to claim 16, wherein the cavity includes:

a lower portion having a shape that is substantially complementary to a shape of the ingot or the bar, and an upper portion having a shape configured to accept material to be cast.

19. The mold according to claim 16, wherein the recess is coupled to the access opening by a duct that is directed toward a bottom of the cavity.

* * * * *